US006971238B1

(12) United States Patent
Walker

(10) Patent No.: US 6,971,238 B1
(45) Date of Patent: Dec. 6, 2005

(54) METHOD FOR DISPOSAL OF PRODUCED WATER

(76) Inventor: Weldon Eugene Walker, 30234 Live Oak Trail, Georgetown, TX (US) 78628

( * ) Notice: Subject to any disclaimer, the term of this patent is extended or adjusted under 35 U.S.C. 154(b) by 16 days.

(21) Appl. No.: 10/822,497

(22) Filed: Apr. 12, 2004

(51) Int. Cl.[7] ..... F03G 7/00
(52) U.S. Cl. ..... 60/641.2; 60/670
(58) Field of Search ..... 60/641.2, 641.3, 60/641.4, 641.5, 670

(56) References Cited

U.S. PATENT DOCUMENTS

| | | | | |
|---|---|---|---|---|
| 3,563,210 A | | 2/1971 | Hoogendam | |
| 3,744,565 A | * | 7/1973 | Brown | 166/267 |
| 3,950,137 A | * | 4/1976 | Larson et al. | 422/81 |
| 4,341,636 A | | 7/1982 | Harder | |
| 4,619,769 A | | 10/1986 | Gritters | |
| 4,710,367 A | | 12/1987 | Wong | |
| 4,776,961 A | | 10/1988 | Gritters | |
| 4,836,891 A | | 6/1989 | Files | |
| 4,898,107 A | | 2/1990 | Dickinson | |
| 5,082,556 A | * | 1/1992 | Reese | 96/159 |
| 5,223,126 A | | 6/1993 | Phillips | |
| 6,142,215 A | * | 11/2000 | Paulsen et al. | 165/45 |
| 6,383,262 B1 | * | 5/2002 | Marthinsen et al. | 95/254 |
| 6,755,249 B2 | * | 6/2004 | Robison et al. | 166/262 |

* cited by examiner

*Primary Examiner*—Hoang Nguyen
(74) *Attorney, Agent, or Firm*—Larry Mason Lee

(57) ABSTRACT

A method and apparatus useful for disposing of the high volumes of produced water associated with coal bed methane natural gas wells. The method taught is to create steam from the produced water and vent the steam into the atmosphere. The apparatus taught utilizes the available field gas to produce heat for enhancing evaporation and drive a steam turbine generator to produce electrical power.

3 Claims, 2 Drawing Sheets

METHOD FOR DISPOSAL OF PRODUCED WATER

BACKGROUND OF THE INVENTION

The present invention is related generally to methods of disposing of wellhead water separated from the production flow of gaseous hydrocarbons flowing out of a producing well. The present invention is further related generally to apparatus useful in methods of disposing of wellhead water which has been separated from the production flow of gaseous hydrocarbons flowing out of a producing natural gas well. More specifically, the present invention is related to devices and apparatus which create and discharge into the atmosphere steam created from the heating of fresh water separated from the flow of gaseous hydrocarbons available at the output of a natural gas producing well.

Many gaseous hydrocarbon producing wells lift large quantities of water along with the gaseous hydrocarbons from the well. Particularly this is true in the gas fields of Wyoming. This wellhead water is troublesome in that it must be separated from the gaseous hydrocarbons being produced and it must be disposed of in an environmentally friendly fashion.

There are several prior art methods of disposing of the fresh water pumped from the collection pond. One method used very often is to pump the water back into a disposal well. Disposal wells are attempts to put the fresh water pumped from the collection pond back into the geologic structure from whence it came. The gaseous hydrocarbon production wells in Wyoming are shallow wells, usually 300 to 1500 foot deep. The disposal well is typically deeper and of greater bore than a gaseous hydrocarbon production well. Several gaseous hydrocarbon production wells are usually served by a single disposal well.

Another method of disposing of the water pumped from the collection pond is to simply pump the water into a groundwater runoff region wince it can flow in a stream merging with natural water flows in the region and area of the producing wells.

Yet another method of disposing of the water pumped from the collection pond is to pump the water into an additional storage pond, either natural or artificial, where the water can be allowed to evaporate into the atmosphere.

A fourth prior art method of disposing of the water pumped from the collection pond is to spread the water over the surface of the surrounding land in a form of irrigation. This dispersion of the water over the surface of the surrounding land relies upon the rate of evaporation of the water from the surface of the land for the rate at which the water which can be disposed of. Additionally, various methods of treating the water being dispersed or of treating the land onto which the water is being dispersed are known to improve the rate of water disposal through irrigation techniques.

The instant invention is of a method of disposing of the water from the collection pond by creation of steam and discharge of the steam into the atmosphere and of the apparatus utilized to create that steam and discharge it into the atmosphere.

Numerous boilers and steam generating apparatus are taught by the prior art. All of such boilers and steam generating apparatus are deficient in one or more particulars for the task accomplished by the instant invention.

There are several problems with the prior art relative to devices and apparatus to generate steam, relative to use in a method of disposing of the water from the collection pond by creation of steam and discharge of the steam into the atmosphere. In particular, it is noted that the apparatus of the prior art is directed toward more efficient steam generation, toward creation of maximum energy steam at the lowest cost in heat energy and water feed. The apparatus of the instant invention is not an efficient generator of steam energy. The apparatus of the instant invention discharges spent steam into the atmosphere and produces electrical energy as a by-product of production. The goal of the instant invention is to discharge the greatest possible quantity of moisture, in the form of steam, into the atmosphere. The instant invention is deliberately inefficient in its use of water to create steam. The more water used, the better.

The are also several problems with the prior art methods of disposing of the fresh water pumped from the collection pond of a producing gaseous hydrocarbon well.

The problems encountered with disposal wells arise because theses wells are injection wells, operated under high pressure and thus such wells are different in kind from the wells in the field of gaseous hydrocarbon wells that produce the fresh water that needs to be disposed of. Usually, therefore, the disposal wells are not located in the same geology as are the producing wells. Transport of the produced fresh water to the disposal wells becomes a problem, an insurmountable economic problem if it is necessary to utilize trucks to transport the fresh water to the site of the disposal wells. This is the case in the Powder River Basin field of gaseous hydrocarbon wells in Wyoming.

The problems encountered with pumping the produced freshwater into a groundwater runoff region is that the produced freshwater sometimes carries substantial quantities of mineral impurities which can act to poison the groundwater and therefore this method of disposal has been banned in most jurisdictions in the United States.

The problems encountered with the utilization of additional water storage ponds, either natural or artificial, is that actual disposal of the fresh water produced depends on the rate of evaporation from the additional water storage ponds. This rate of evaporation acts as a cap on the rate of production of gaseous hydrocarbons from the wells, an economically unacceptable cap.

The problems encountered with use of irrigation as a method of disposal of produced fresh water primarily are created by the local geography in the Wyoming gas fields. In those fields, and areas adjoining the fields, there is a layer of clay at or near the surface of the soil. The clay precludes absorption of the fresh water into the ground at any meaningful rate. This method is used commonly, but its success is limited to the rate of evaporation of the produced fresh water into the atmosphere that, as above-mentioned, is an unacceptable economic cap on the production from the wells.

SUMMARY OF THE INVENTION

In brief summary, the present invention is of a method of disposing of the fresh water from the collection pond for the output of a gaseous hydrocarbon producing well by creation of steam and discharge of the steam into the atmosphere. The instant invention is additionally of the apparatus specifically designed to practice such method and utilized to create and discharge the steam created from the water from the collection pond for the output of a gaseous hydrocarbon producing well.

Injecting produced water into disposal wells has been used in oil and gas fields as a standard disposal method for decades. These wells require governmental permits and are strictly monitored. Drilling a successful well is difficult at best and sometimes not possible. This seems to be the case in some of the natural gas fields of the Rocky Mountain region. The problem seems to be the tight geological formation simply prevents water injection. One of the few successful disposal methods is an irrigation system, however this system is expensive, labor intensive, and weather conditions limit use to six to eight months of the year. The temporary solution is to build more earth storage ponds as a means to continue production. The U.S. Department of Energy's case study report concludes that more than 39 trillion cubic feet of coalbed methane gas is technically recoverable. Actual production will depend on the success of the chosen water disposal method.

Several problems have been noted in prior art and the instant invention was developed to overcome such known problems. Accordingly, it is a general object of this invention to provide a method of disposing of the produced fresh water from the gaseous hydrocarbon wells that does not require use of disposal wells or transportation of the fresh water out of the gaseous hydrocarbon production fields.

It is another object of this invention is to provide a method of disposing of the produced fresh water from the gaseous hydrocarbon wells that does not depend on the rate of evaporation of the produced fresh water into the atmosphere.

It is yet another object of this invention is to provide a method of disposing of the produced fresh water from the gaseous hydrocarbon wells that does not depend on the rate of absorption of the produced fresh water into the ground.

It is a yet further and final object of this invention is to provide an apparatus useful in the practice of a method of disposing of the produced fresh water from the gaseous hydrocarbon wells that creates steam and discharges that steam into the atmosphere.

Other objects and advantages of the present invention will be apparent upon reading the following description and appended claims.

DESCRIPTION OF THE NUMERIC REFERENCES

No. Description

10 Apparatus of the instant invention
20 Water Storage Pond and Gathering System
25 Electrical Power Production Line
26 Electrical Signal Communication Line
40 Well and Wellhead
50 Natural Gas Production Line
100 Wellhead Production System using Steam disposal of produced freshwater
105*a* Steam Flow Line
105*b* Steam Flow Line
115 Fluid Communication Line from the Water Storage Pond to the Apparatus of the Instant Invention
120 Fluid Communication Line from the Production Wellhead to the Water Storage Pond
125 Fluid Communication Line from the Apparatus of the Instant Invention to the Water Storage Pond
130 Input Water Flow Meter
135 Fluid Communication Line from the Inlet Certified Flow Meter to the Water Sample Valve
135*a* Fluid Communication Line from the Water Sample Valve to the Air Actuated High Pressure Safety Shutoff Valve
135*b* Fluid Communication Line from the Air Actuated High Pressure Safety Shutoff Valve to the Water Filter
140 Water Sample Valve
145 Safety Low Pressure Sensor
150 Filtering System
155 a Fluid Communication Line
160 a Fluid Communication Line
165 a Fluid Communication Line
166 a Fluid Communication Line
170 First Circulating Valve
175 Second Circulating Valve
180 Secondary Coils
185 a Fluid Communication Line
190 a Fluid Communication Line
195 Air Duct System
200 Electric Blower
205 Eight Pass Manifold
210 Primary Coils
215 a Fluid Communication Line
220 Exhaust Burner Chamber
225 Burner Assembly
230 Output Water Flow Meter
235 Natural Gas Line
235*a* Input Natural Gas Line
240 Main Control Panel
245 an Electrical Signal Communication Line
246 an Electrical Signal Communication Line
250 an Electrical Communication Line
255 an Electrical Communication Line
260 Steam/Water Separator
265 a Steam Communication Line
275 a Fluid Communication Line
280 Electric Safety Switch
285 an Exhaust Vent Stack
290 an Exhaust Vent Stack
295 255 HP Steam Turbine
300 an Electrical Signal Communication Line
305 Steam Sample Valve
310 175 KW Generator
315 an Electrical Communication Line
320 Air Actuated High Pressure Safety Shutoff Valve
325 Air Compressor With Holding Tank
330 a Compressed Air Communication Line
335 a Water Flow Valve
340 a Steam Flow Valve
345 High Pressure Safety Valve
350 a Fluid Communication Line
351 Water Flow Bypass Line
352 Fluid Communication Line
355 a Steam Flow Line
360 a Steam Flow Line
365 Water Pre-Heating Assembly

DESCRIPTION OF THE DRAWINGS

While the novel features of the instant invention are set forth with particularity in the appended claims, a full and complete understanding of the invention can be had by referring to the detailed description of the preferred embodiment(s) which is set forth subsequently, and which is as illustrated in the accompanying drawings, in which:

DESCRIPTION OF THE PREFERRED EMBODIMENT(S)

Figure 1:
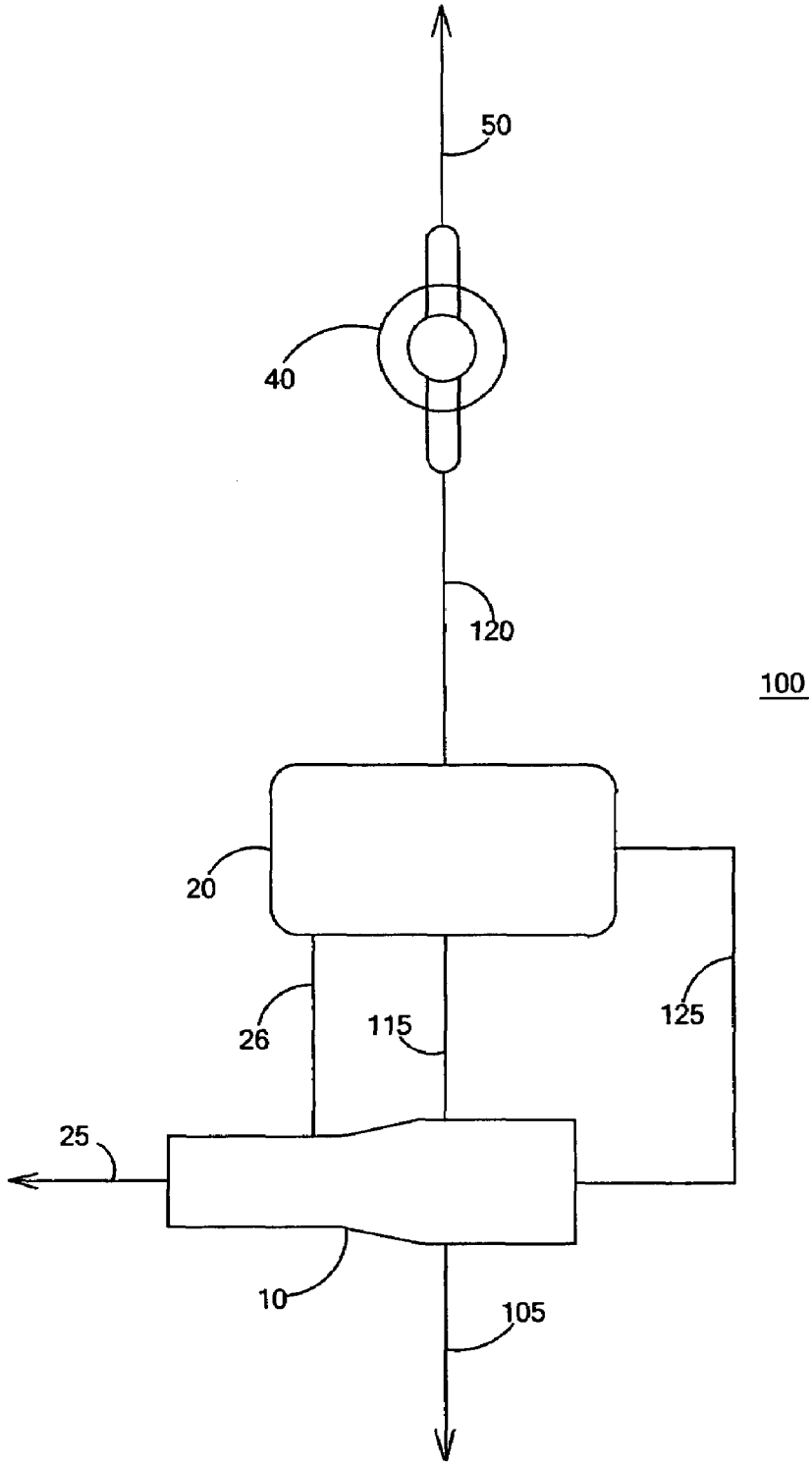
FIG. 1 is a block diagram of a system 100 practicing the method of the instant invention.

As is seen by reference to FIG. 1, the instant invention is of a method of disposing of the produced fresh water communicated 115 from the water storage pond 20 for the output of a gaseous hydrocarbon producing well 40 by creation of steam in the apparatus of the instant invention 10 and discharge of the steam through the steam flow communication line 105 into the atmosphere. The instant invention is additionally of the apparatus 10 specifically designed to practice such method and utilized to create and discharge the steam created from the water which was communicated 115 from the water storage pond and gathering system 20 at the output of a gaseous hydrocarbon producing well 40.

FIG. 1 is a block diagram of a system 100 which practices the method of the instant invention and depicts the apparatus 10 of the instant invention in flow position relative to the other major components of the system 100. The system 100 comprises a gaseous hydrocarbon producing well and wellhead 40 which is in fluid communication with a water storage pond and gathering system 20 via the fluid communication line 120. The gaseous hydrocarbon producing well and wellhead 40 also has a natural gas output which is depicted as output via natural gas flow line 50. The water storage pond and gathering system 20 is in fluid communication 115 with the input to the apparatus 10 and is in fluid communication 125 with an output of the apparatus 10. Additionally, the apparatus 10 provides electrical signal communication of shutdown and other safety level violations to the water storage pond and gathering system 20 via electrical signal communication line 26. The other outputs of the apparatus 10 are steam via the steam flow line 105 and electrical power via the electrical power production line 25. Thus, the system 100 is seen to have three outputs: natural gas via the natural gas flow line 50, steam via the steam flow line 105, and electrical power via the electrical power production line 25; and the system 100 is shown to have but a single input, the combined natural gas and fresh water produced from the well and wellhead 40. The apparatus 10 of the instant invention utilizes the water input by fluid communication 115 from the water storage pond 20 to create steam which is output via the steam flow line 105 into the atmosphere.

Figure 2:
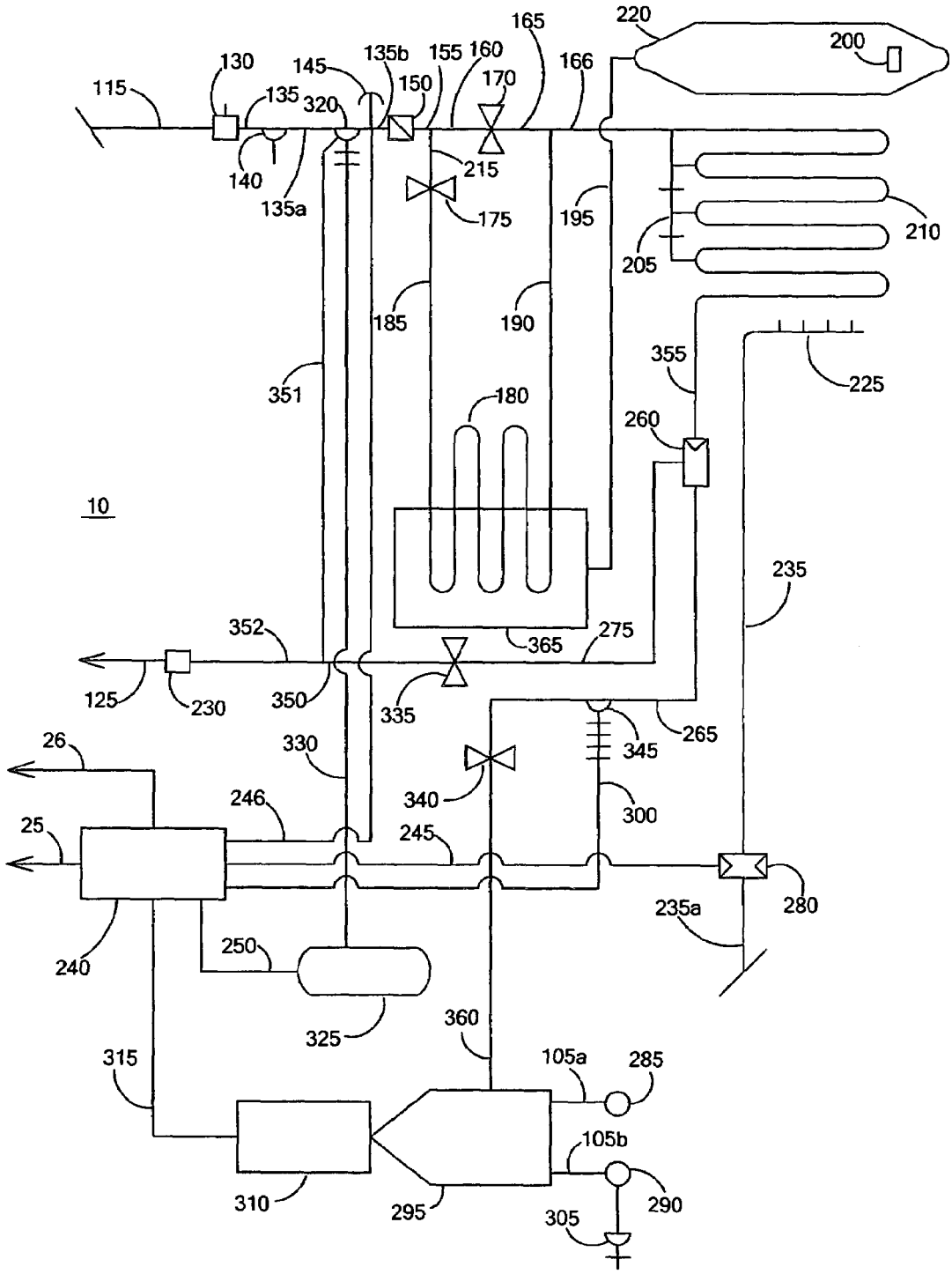
FIG. 2 is a schematic drawing of the apparatus 10 which disposes of the excess fresh water generated by the system 100 as steam 105.

FIG. 2 is a schematic diagram of the apparatus 10 of the instant invention. FIG. 2 depicts the water flow from the water storage pond 20 to the apparatus 10 as taking place via fluid flow communication line 115, and depicts the water flow from the apparatus 10 to the water storage pond 20 as taking place via fluid flow communication line 125.

The apparatus 10 comprises in gross partition a fluid communication line 115 which provides fresh water into the apparatus 10, a filter system 150 which filters the fresh water in, a set of primary heating coils 210 which are heated by a natural gas burner assembly 225, a water pre-heating assembly 365 which pre-heats the filtered water being fed into the primary heating coils 210, a water-steam separator 260 which permits the high pressure, live steam output of the primary heating coils 210 to flow into a steam turbine 295 which drives an electrical generator 310 and outputs low pressure, spent steam through exhausts 285 and 290 via steam flow lines 105*a* and 105*b*, respectively.

In greater particularity, and continuing reference to FIG. 2, the apparatus 10 receives fresh water from the water storage pond 20 via the fluid communication line 115. The fresh water received by the apparatus 10 through fluid flow line 115 is first metered by the input water flow meter 130 and then output from the input water flow meter 130 through fluid communication line 135 to the water sample valve 140. The fresh water out of the normally closed water sample valve 140, opened only when a sample is to be taken by diverting the flow out of the water sample valve 140 away from fluid communication line 135*a*, is input to the air actuated high pressure safety shutoff valve 320 through fluid communication line 135*a*. The air actuated high pressure safety shutoff valve 320 has two possible outputs, fluid communication line 135*b* which inputs fresh water to the filtering system 150 and fluid communication line 351 which inputs fresh water into fluid communication line 352. If the fresh water is routed by the air actuated high pressure safety shutoff valve 320 into the fluid flow communication line 135*b*, then the fresh water is input to the water filtering system 150 and is filtered. If the fresh water is routed by the air actuated high pressure safety shutoff valve 320 into the fluid flow communication line 351, then the fresh water flow will be via the fluid communication line 352 into the output water flow meter 230 and thence via fluid communication line 125 back into the water storage pond 20.

The filtered fresh water output of the filtering system 150 is output from the filtering system 150 through fluid communication line 155. Fluid communication line 155 splits into two fluid communication lines, 160 and 215. The fresh water flow into fluid communication line 160 is controlled by the setting of the first circulating valve 170. The fresh water flow into fluid communication line 215 is controlled by the setting of the second circulating valve 175. Fresh filtered water output from the filtering system 150 flows through fluid communication line 160 into the first circulating valve 170 and is output from the first circulating valve 170 via fluid communication line 165. Fresh filtered water output from the filtering system 150 also flows through fluid communication line 215 into the second circulating valve 175 and is output from the second circulating valve 175 via fluid communication line 185. The output of the first circulating valve 170 is input to primary coils 210 of the eight pass manifold 205 through fluid communication line 166 via fluid communication line 165. Fluid communication line 166 has as input the outputs of both fluid communication line 165 and fluid communication line 190.

The output of the second circulating valve 175 is input to the secondary coils 180 through the fluid communication line 185. The secondary coils 180 are contained within an exhaust heat exchanger 365 and serve to pre-heat the filtered fresh water output of the secondary coils 180. The exhaust heat exchanger 365 is fed hot air by the air duct system 190. The hot air is forced into the air duct system 190 by the electric blower 200 which is located within the exhaust burner chamber 220. The pre-heated fresh filtered water output of the secondary coils 180 is output from the secondary coils 180 through fluid communication line 190.

The fresh filtered water flow out of the fluid communication line 190 is input into the fluid communication line 166 which flows into the primary coils 210. The eight pass manifold 205 and the primary coils 210 within it are heated by the burner assembly 225 which is fed natural gas through the natural gas line 235. The hot gas output of the burner assembly 225 is through the exhaust burner chamber 220 and then vented into the atmosphere. The fresh filtered water in the primary coils 210 is heated to a high pressure steam-water mixture which is output from the primary coils 210 to the steam/water separator 260 through the steam flow line 355.

The steam/water separator 260 acts to separate the steam from the hot water and let the steam pass into the steam flow line 265 while diverting the hot water into fluid communication line 275. Hot water flowing into fluid communication line 275 flows into the water flow valve 335 and from water flow valve 335 out into fluid communication line 350. The output of fluid communication line 350 is into fluid communication line 352 and the output of fluid communication line 352 is into the output water flow meter 230.

The output of the output water flow meter 230 is into fluid communication line 125 which flows fresh water back into the water holding pond 20, see FIG. 1. The steam flowing into steam flow line 265 is output into steam flow valve 340. The steam output of the steam flow valve 340 is input as high pressure live steam to the steam turbine 295 through steam flow line 360. The high pressure wet steam input to the steam turbine 295 imparts the energy to the steam turbine 295 to drive a generator 310 and, in the process, reduces the high pressure, live steam to low pressure, spent steam which is exhaust from the steam turbine 295 through the steam flow lines 105*a* and 105*b* to the exhaust vent stacks 285 and 290 where the steam is vented into the atmosphere.

The electricity output from the generator 310 through the electrical communication line 315 to the electrical control panel 240 is available for use throughout the apparatus 10 and the excess is output from the electrical control panel via the electrical power production line 25 and is available to operate other equipment at the wellhead 40 production site. The steam output from the steam turbine 295 through the exhaust vent stacks 285 and 290 is the apparatus' 10 product, fresh water disposed of as steam into the atmosphere. A steam sample valve 305 is provided to check the quality and content of the steam being released into the atmosphere.

The preferred embodiment of the apparatus, by continued reference to FIG. 2, also provides a safety and control system which prevents operation during excessive temperature and pressure conditions. The input flow of fresh water into the air actuated high pressure safety shutoff valve 320 will be diverted into fluid flow communication line 351 in the event that air actuated high pressure safety shutoff valve 320 senses a high pressure safety violation. The air actuated high pressure safety shutoff valve 320 is, as the name suggests, air actuated by the constant air pressure fed into it by the compressed air communication line 330. The air actuated high pressure safety shutoff valve 320 of the preferred embodiment actually uses mechanical detection of the high pressure condition and uses the compressed air as power to divert the fresh water flow, ie. to change the valve position from its normal output into fluid communication line 135*b* to an output into fluid communication line 351. The compressor 325 is powered by electricity input via electrical communication line 250 and electrical communication line 250 receives the electricity from the control panel 240. When the air actuated high pressure safety shutoff valve 320 actuates, the flow of fresh water is no longer into fluid communication line 135*b* and the safety low pressure sensor 145 which is installed on fluid communication line 135*b* will detect the lack of fluid pressure in fluid communication line 135*b* and will generate an electrical signal which is communicated back to the control panel 240 via electrical communication line 246. Upon receipt of the low pressure signal from the safety low pressure sensor 145, the control panel 240 will generate an electrical signal which acts to cause electric safety switch 280 to stop the flow of natural gas into the natural gas line 235. The electrical signal is communicated from the control panel 240 to the electric safety switch 280 via electrical signal communication line 245. The normal flow of natural gas from the input natural gas line 235*a* into the natural gas line 235 is halted by the actuation of the electric safety switch 280.

The high pressure safety valve 245 senses the pressure within the steam flow communication line 265 and acts to cut off the flow of steam into the steam turbine 295 when a high pressure condition is encountered. In addition to mechanically closing and cutting off the steam flow within steam flow line 265 which would normally feed into the steam flow valve 340, the high pressure safety valve 245 also generates an electrical signal which is input to the control panel 240 via electrical signal communication line 300. Upon receipt of the electrical signal from the high pressure safety valve 245 by the control panel 240, the control panel 240 acts to generate an electrical signal which is conveyed to the electric safety switch 280 via the electrical signal communication line 245. As above described, receipt of the electrical signal by the electric safety switch 280 causes the electric safety switch 280 to cut off the flow of natural gas into the natural gas line 235 which effectively closes down the operation of the apparatus 10.

With reference to FIG. 2, in operation of the preferred embodiment, fresh water produced from the gas wells 40 is sent to water storage ponds 20, and that the fresh water that is not converted into steam and discharged into the atmosphere is flowed back through fluid flow line 125 to the water storage ponds 20. It should be noted that the result of this flow of water not converted to steam causes the water in the water storage ponds 20 to maintain an approximate temperature of 65 degrees F. Using a submersible pump placed into the water storage pond 20 with a skimming technique allows many of the particulates contained in the water to drop out and settle to the bottom of the water storage pond 20. The system water flow, water flow within the apparatus 10, begins with the submersible pump producing a minimum of 150 gallons per minute @ 200 PSI through a 3" diameter pipe which serves as the input fluid flow communication line 115. The certified flow meter 130, being the next step, is the means utilized to track barrels of fresh water disposal by the apparatus 10. Typically, a 3" diameter is the required inlet and outlet size for the input and output fluid flow lines, 115 and 125 respectively. The sample valve 140 is required for testing the water flow into the apparatus 10 to maintain steam turbine 295 minimums and environmental control. A safety low pressure sensor 145 is required to monitor water flow into the apparatus 10 before it enters the filtering system 150 to address any unexpected problems concerning water flow blockage. The apparatus 10 has incorporated an air actuated high pressure safety shutoff valve 320 as an additional safety device. The air actuated high pressure safety shutoff valve 320 is air pressure actuated by a compressor and holding tank 325 acting through the compressed air communication line 330 and monitored from the control panel 240. The requirements of the filtering system 150 are adjusted to fulfill governmental environment issues. In short, permits, indicating compliance with relevant governmental regulations, dictate size, content and flow rates within the apparatus 10. One of the substantial advantages of the design of the apparatus 10 is the flexibility in size and flow rate that is possible, and thus the ability of the apparatus 10 to allow the production operator to comply with the various relevant regulations. The two circulating valves 170 and 175 are used during the apparatus' 10 start up procedure and adjusted for desired system efficiency. The water flow returning to the storage pond 25 during this start up phase is monitored with a second certified flow meter, the output water flow meter 230, for accurate disposal rates. The heat recovery method using the secondary set of coils 180 is designed to preheat the water flow. This secondary coil system 180 reduces the fuel consumption by recovering heat from the exhaust burner chamber 220 by means of duct 195 and electric blower 200 components. The manifold 205 and primary coil 210 design of the heat exchanger is of a specific, unusual in light of the prior art, nature. Historically, tubular boiler systems are designed to keep water consumption to a minimum, because water introduces an added expense to the process. The instant invention 10, on the other hand, is designed to consume as much water as possible as a means of water disposal. The heat exchanger manifold 205 is constructed with an eight pass primary coil 210 arrangement and is fed by a 3" header from fluid flow communication line 165. Construction meets ASME Section I Specifications Stamped with the "S" Symbol and Registered with the National Board. The safety bypass system is used during startup procedure and when any temperature, pressure or flow problems are encountered. The burner assembly 225 features a natural gas fired up-draft type system with a maximum 16,000,000 BTU input with a dual direct spark ignition. A 1" natural gas line 18 with a minimum 50 PSI is required for optimum burner 225 performance. Efficiency is monitored by use of the certified gas meter, not depicted. An electric natural gas flow safety switch 280 is attached to the gas line 235 which is monitored from the main control panel 240 for automatic shut down to ensure operation within safe pressure limits.

The primary tubular coils 210 represent the next stage of flow. Heated water is flashed to steam as the flow exits the primary coils 210 and passes through the steam/water separator 260. Dry and saturated steam enters the steam turbine 295 @ 150 PSI and exits @ 2 PSI through dual 6" diameter exhaust vent stacks 122 with a steam sample valve 305 attached. Steam flow of 12,000 lbs/hr is expected and will produce 255 HP shaft out put, which converts to a 175 KW generator 310.

ECONOMIC BENEFIT STATEMENT

Economically, the instant invention provides certain advantages as a solution to the petroleum industry's problem of disposing of water produced at the wellhead. A current limitation on the production of natural gas fields in the Rocky Mountain region is the volumetric limitations on the disposal of co-produced freshwater from the gas wells. Such limitations are on the volume of water that can be re-injected into the field without affecting the groundwater tables and on the volume of water that can be added to the local surface water flows without environmentally impacting the areas surrounding the fields. Thus, increasing the volume of available freshwater disposal from natural gas fields in the Rocky Mountain region would have a substantial impact on the available increases in natural gas production. The simplicity and combination of well-known technologies provided by this invention creates a reliable, proficient, and efficient, workable method of increasing available natural gas production. Increased natural gas production will serve to make available energy at a lower overall cost and will help support the growth of the economy.

CONCLUSION

While the preferred embodiments of the method and apparatus of the instant invention 10 have been described in substantial detail and fully and completely hereinabove, it will be apparent to one skilled in the art that numerous variations of the instant invention 10 may be made without departing from the spirit and scope of the instant invention 10, and accordingly the instant invention 10 is to be limited only by the following claims.

What is claimed is:

1. A method of disposing of fresh water produced by a hydrocarbon well comprising the steps of:

receiving fresh water produced by a hydrocarbon well, metering the input flow of said fresh water, filtering said fresh water, using a source of natural gas to heat said fresh water to create live steam, using said live steam to drive a steam turbine, using the mechanical output of said steam turbine to drive a generator, and exhausting the spent steam from said steam turbine into the atmosphere.

2. The method of claim 1 additionally comprising the steps of:

using the electrical output of said generator to operate a natural gas cut-off valve, using the electrical output of said generator to operate an air compressor, using said natural gas cut-off valve to control said source of said natural gas, using the pneumatic output of said air compressor to operate an air actuated high pressure safety shutoff valve, using said air actuated high pressure safety shutoff valve to control said input flow of said fresh water, using said source of natural gas to pre-heat said fresh water, and metering the output flow of said fresh water.

3. Apparatus useful in the disposal of fresh water produced from the wellhead of a hydrocarbon well comprising:

an input flow metering system, a filter system, a first fluid flow valve, a primary coil, a natural gas burner system, a natural gas safety cut-off valve, a steam/water separator, a first steam flow valve, a steam turbine, a generator, a power control and distribution panel, an air compressor and holding tank, an air actuated high pressure safety shutoff valve, a second steam flow valve, an outlet return flow meter, a second water flow valve, a secondary coil, an exhaust burner chamber, and a steam exhaust vent;

wherein said fresh water is input to said input flow metering system, the output of said input flow metering system is in fluid flow communication with the input of said air actuated high pressure safety shutoff valve, the output of said air actuated high pressure safety shutoff valve is in fluid flow communication with the input of said filter system, the output of said filter system is in fluid flow communication with the input of said first water flow valve, the output of said first water flow valve is in fluid flow communication with the input of said primary coil, the output of said primary coil is in steam flow communication with the input of said steam/water separator, the output of said steam/water separator is in steam flow communication with the input of said first steam flow valve, the output of said first steam flow valve is in steam flow communication with the input of said steam turbine, the mechanical output of said steam flow turbine is in mechanical communication with the input of said generator, the steam output of said steam flow turbine is in steam flow communication with the input to said steam exhaust vent, the electrical output of said generator is in electrical communication with the input to said electrical control panel, the heat output of said natural gas burner system is in heat transfer communication with said primary coil, the heat output of said natural gas burner system is in heat transfer communication with said secondary coil, the output of said filter system is in fluid flow communication with the input of said second water flow valve, the output of said second water flow valve is in fluid flow communication with the input of said secondary coil, the output of said secondary coil is in fluid flow communication with the input of said primary coil, the output of said steam/water separator is in steam flow communication with the input of said second steam flow valve, the output of said second steam flow valve is in steam flow communication with the input of said outlet return flow meter, the output of said outlet return flow meter is in fluid flow communication with the source of said fresh water, the output of said electrical control panel is in electrical communication with the input to said natural gas safety cut-off valve, the output of said electrical control panel is in electrical communication with the input to said air compressor and holding tank, the output of said air compressor and holding tank is in pneumatic communication with the input of said air actuated high pressure safety shutoff valve, the output of said natural gas safety cut-off valve is in gas flow communication with the input to said natural gas burner system, and the input of said natural gas safety cut-off valve is in gas flow communication with a source of natural gas.

* * * * *